US007573208B2

(12) United States Patent
Newman, Jr.

(10) Patent No.: US 7,573,208 B2
(45) Date of Patent: Aug. 11, 2009

(54) METHOD OF PROGRAMMING A LIGHTING PRESET FROM A RADIO-FREQUENCY REMOTE CONTROL

(75) Inventor: Robert C. Newman, Jr., Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 220 days.

(21) Appl. No.: 11/713,854

(22) Filed: Mar. 5, 2007

(65) Prior Publication Data

US 2008/0218099 A1 Sep. 11, 2008

(51) Int. Cl.
*H05B 37/02* (2006.01)

(52) U.S. Cl. ..... 315/294; 315/149; 315/307

(58) Field of Classification Search ..... 315/149, 315/158, 291, 295, 307, 321, 294; 359/355–356; 340/3.5–3.355; 700/3, 9, 11, 20
See application file for complete search history.

(56) References Cited

U.S. PATENT DOCUMENTS

| | | | | |
|---|---|---|---|---|
| 5,237,264 | A | 8/1993 | Moseley et al. | |
| 5,463,286 | A * | 10/1995 | D'Aleo et al. | 315/295 |
| 5,637,964 | A | 6/1997 | Hakkarainen et al. | |
| 5,736,965 | A | 4/1998 | Mosebrook et al. | |
| 5,838,226 | A | 11/1998 | Houggy et al. | |
| 5,848,054 | A | 12/1998 | Mosebrook et al. | |
| 5,905,442 | A | 5/1999 | Mosebrook et al. | |
| 5,909,087 | A * | 6/1999 | Bryde et al. | 315/149 |
| 5,982,103 | A | 11/1999 | Mosebrook et al. | |
| 6,037,721 | A | 3/2000 | Lansing et al. | |
| 6,169,377 | B1 | 1/2001 | Bryde et al. | |
| 6,300,727 | B1 | 10/2001 | Bryde et al. | |
| 6,310,440 | B1 | 10/2001 | Lansing et al. | |

(Continued)

FOREIGN PATENT DOCUMENTS

EP 1122985 A1 8/2001

(Continued)

OTHER PUBLICATIONS

Lutron Electronics Co., Inc., Radio RA Installer's Guide, Dec. 2004, 16 pages.

(Continued)

*Primary Examiner*—David Hung Vu
*Assistant Examiner*—Tung X Le
(74) *Attorney, Agent, or Firm*—Mark E. Rose; Philip N. Smith

(57) ABSTRACT

The present invention provides a method of programming a preset intensity of a dimmer switch from a radio-frequency (RF) remote control. A user is able to adjust the intensity of the lighting load to a new intensity and subsequently press and hold a preset button on the remote control to program the new intensity as the preset intensity. The remote control transmits a wireless transmission to the dimmer switch, which immediately responds to the actuation of the preset button by controlling the intensity of the lighting load to an old preset intensity. The dimmer switch then blinks a light-emitting diode representative of the new intensity to provide feedback that the dimmer switch is in the process of programming the preset intensity to the new intensity. Eventually, the dimmer switch stores the new intensity as the preset intensity and stops blinking the light-emitting diode.

19 Claims, 8 Drawing Sheets

U.S. PATENT DOCUMENTS

| | | | | |
|---|---|---|---|---|
| 6,380,696 | B1 | 4/2002 | Sembhi et al. | |
| 6,545,434 | B2 | 4/2003 | Sembhi et al. | |
| 6,667,578 | B2 | 12/2003 | Lansing et al. | |
| 6,687,487 | B1 | 2/2004 | Mosebrook et al. | |
| 6,794,830 | B2 | 9/2004 | Lansing et al. | |
| 6,803,728 | B2 | 10/2004 | Balasubramaniam et al. | |
| 6,927,547 | B2 | 8/2005 | Walko, Jr. et al. | |
| 7,071,634 | B2 | 7/2006 | Johnson et al. | |
| 7,126,291 | B2 * | 10/2006 | Kruse et al. | 315/316 |
| 7,142,932 | B2 | 11/2006 | Spira et al. | |
| 7,166,970 | B2 | 1/2007 | Johnson et al. | |
| 7,259,524 | B2 | 8/2007 | Hausman, Jr. et al. | |
| 7,382,100 | B2 | 6/2008 | Johnson et al. | |
| 2005/0137720 | A1 * | 6/2005 | Spira et al. | 700/19 |
| 2005/0146288 | A1 | 7/2005 | Johnson et al. | |
| 2006/0012317 | A1 | 1/2006 | Chiu et al. | |
| 2006/0272569 | A1 | 12/2006 | Lehmer et al. | |
| 2006/0284734 | A1 | 12/2006 | Newman, Jr. | |

FOREIGN PATENT DOCUMENTS

| | | | |
|---|---|---|---|
| WO | WO97/29560 | A | 8/1997 |

OTHER PUBLICATIONS

Lutron Electronics Co., Inc., Radio RA Visor Control Transmitter Specification Submittal, Jan. 2002, 2 pages.
Lutron Electronics Co., Inc., Radio RA Visor Control Transmitter Installation Instructions, Nov. 2001, 2 sheets.
Johnson Controls, HomeLink Operating Instructions and Programming Guidelines, Aug. 23, 2004, 7 pages.
U.S. Appl. No. 11/559,166, filed Nov. 13, 2006, Spira.
European Patent Office, International Search Report and Written Opinion for International Patent Application No. PCT/US2008/002842, Jun. 19, 2008, 13 pages.

* cited by examiner

METHOD OF PROGRAMMING A LIGHTING PRESET FROM A RADIO-FREQUENCY REMOTE CONTROL

BACKGROUND OF THE INVENTION

1. Field of the Invention

The present invention relates to a wireless lighting control system for controlling the amount of power delivered to an electrical load from a source of alternating-current (AC) power, and more particularly, to a method of programming a lighting preset from a radio-frequency (RF) remote control.

2. Description of the Related Art

Control systems for controlling electrical loads, such as lights, motorized window treatments, and fans, are known. Such control systems often use radio-frequency (RF) transmission to provide wireless communication between the control devices of the system. One example of an RF lighting control system is disclosed in commonly-assigned U.S. Pat. No. 5,905,442, issued on May 18, 1999, entitled METHOD AND APPARATUS FOR CONTROLLING AND DETERMINING THE STATUS OF ELECTRICAL DEVICES FROM REMOTE LOCATIONS, the entire disclosure of which is hereby incorporated by reference.

The RF lighting control system of the '442 patent includes wall-mounted load control devices, table-top and wall-mounted master controls, and signal repeaters. The control devices of the RF lighting control system include RF antennas adapted to transmit and receive the RF signals that provide for communication between the control devices of the lighting control system. All of the control devices transmit and receive the RF signals on the same frequency. Each of the load control devices includes a user interface and an integral dimmer circuit for controlling the intensity of an attached lighting load. The user interface has a pushbutton actuator for providing on/off control of the attached lighting load and a raise/lower actuator for adjusting the intensity of the attached lighting load. The load control devices may be programmed with a preset lighting intensity that may be recalled later in response to an actuation of a button of the user interface or a received RF signal.

The table-top and wall-mounted master controls each have a plurality of buttons and are operable to transmit RF signals to the load control devices to control the intensities of the lighting loads. The signal repeaters initiate configuration procedures for the RF lighting control system and help to ensure error-free communication by repeating the RF signals to ensure that every device of the system reliably receives the RF signals. To prevent interference with other nearby RF lighting control systems located in close proximity, the RF lighting control system of the '442 patent preferably uses a house code (i.e., a house address), which each of the control devices stores in memory. Each of the control devices of the lighting control system is also assigned a unique device address (typically one byte in length) for use during normal system operation to avoid collisions between transmitted RF communication signals.

It is desirable to set the value of the preset lighting intensity of one of the load control devices from a remote control (e.g., from the table-top master control). Prior art wireless lighting control systems have included methods of programming the preset intensity of a load control device from an infrared (IR) remote control. To program a new lighting preset, a user adjusts the intensity of the lighting load to a desired level and then presses and holds a button on the IR remote control for a predetermined amount of time. The IR remote transmits a plurality of IR signals to the load control device while the button is held. The load control device determines that the button of the IR remote control is being held and stores the preset intensity of the lighting load as the new preset intensity. Preferably, the load control device receives a predetermined number of IR signals, e.g., ten IR signals, before determining that the button is being held. FCC limitations on average intentional power transmitted.

The Federal Communications Commission (FCC) regulates telecommunications and the use of the radio spectrum, including radio-frequency communications, in the United States. The rules of the FCC are provided in Title 47 of the Code of Federal Regulations. Specifically, Part 15 is directed towards radio-frequency devices. For control systems, such as RF lighting control systems, continuous transmissions are not allowed. However, periodic transmissions are acceptable as long as the FCC limitations on the average intentional power transmitted are observed. As a consequence of complying with the FCC regulations, RF lighting control systems can only transmit a limited number of RF signals in a given time period.

Because of the limitations on how often a control device of an RF lighting control system can transmit RF signals, an RF control device receiving an RF signal must respond rather quickly to the received RF signal, for example, after receiving only one or two RF signals. Therefore, when a button is held on an RF remote control, an RF load control device receiving an RF signal from the remote control cannot wait for ten RF signals (i.e., to determine that the button is being held) before responding to the RF signal. When a button is pressed and held on an RF remote control to program a new preset intensity, the load control device must control the lighting load immediately in response to the RF signal. Then the load control device can subsequently determine that the button is being held and store a new preset intensity. This sequence of events can be confusing to a user.

Therefore, there is a need for an improved method of programming a lighting preset of a load control device from an RF remote control.

SUMMARY OF THE INVENTION

The present invention provides a method of programming a preset intensity of a load control device. The load control device is operable to control the amount of power delivered to a lighting load from an AC power source such that the lighting load is illuminated to the preset intensity. The method comprises the steps of: (1) controlling the intensity of the lighting load to an old preset intensity in response to receiving a wireless transmission; (2) providing a visual indication representative of a new intensity in response to receiving a first predetermined number of the wireless transmissions with no more than a first predetermined time period between two consecutive wireless transmissions; and (3) storing the new intensity as the preset intensity in response to receiving a second predetermined number of the wireless transmissions with no more than a second predetermined time period between two consecutive wireless transmissions.

The present invention further provides a dimmer switch for controlling the amount of power delivered to a lighting load from an AC power source such that the lighting load is illuminated to a preset intensity. The dimmer switch comprises a controllably conductive device, a controller, a wireless receiver, and a plurality of visual indicators. The controllably conductive device is adapted to be coupled in series electrical connection between the AC power source and the lighting load, the controllably conductive device having a control input. The controller is operatively coupled to the control input of the controllably conductive device for controlling the intensity of the lighting load. The wireless receiver is operable to receive a wireless transmission and is coupled to the controller such that the controller is responsive to the wireless transmission. The visual indicators are coupled to the controller and are operable to provide a representation of the intensity of the lighting load. The controller is operable to control the intensity of the lighting load to a new intensity. The controller is further operable to control the intensity of the lighting load to an old preset intensity in response to receiving the wireless transmission, to blink one of the plurality of visual indicators representative of the new intensity in response to receiving a first predetermined number of the wireless transmissions with no more than a first predetermined time period between two consecutive wireless transmissions, and to store the new intensity as the preset intensity in response to receiving a second predetermined number of the wireless transmissions with no more than a second predetermined time period between two consecutive wireless transmissions.

In addition, the present invention provides a lighting control system for controlling the amount of power delivered to a lighting load from an AC power source such that the lighting load is illuminated to a preset intensity. The lighting control system comprises a remote control operable to transmit a wireless transmission in response to an actuation of a button. The lighting control system further comprises a dimmer switch operable to control intensity of the lighting load to a new intensity. The dimmer switch is further operable to control the lighting load to an old preset intensity in response to receiving the wireless transmission, to provide a visual indication representative of the new intensity in response to receiving a first predetermined number of the wireless transmissions with no more than a first predetermined time period between two consecutive wireless transmissions, and to store the new intensity as the preset intensity in response to receiving a second predetermined number of the wireless transmissions with no more than a second predetermined time period between two consecutive wireless transmissions.

Other features and advantages of the present invention will become apparent from the following description of the invention that refers to the accompanying drawings.

DETAILED DESCRIPTION OF THE INVENTION

Figure 1:
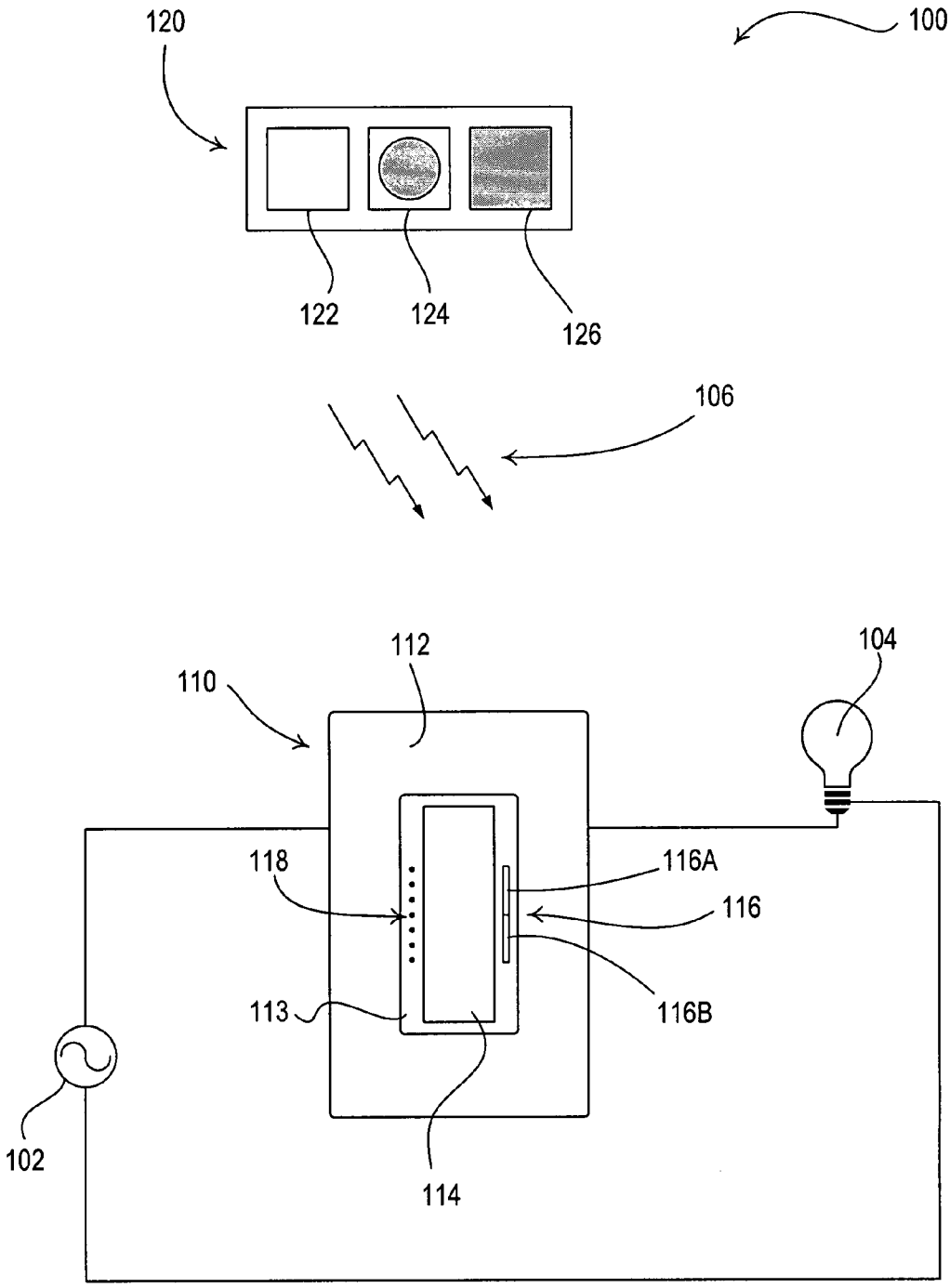
FIG. 1 is a simple diagram of an RF lighting control system according to the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simple diagram of an RF lighting control system 100 according to the present invention. The lighting control system 100 comprises a remotely-controllable load control device, i.e., a dimmer switch 110, and a remote control 120. Preferably, the dimmer switch 110 is adapted to be wall-mounted in a standard electrical wallbox. The dimmer switch 110 is operable to be coupled in series electrical connection between an AC power source 102 and an electrical lighting load 104 for controlling the amount of power delivered to the lighting load. The dimmer switch 110 comprises a faceplate 112 and a bezel 113 received in an opening of the faceplate.

The dimmer switch 110 further comprises a toggle actuator 114, i.e., a button, and an intensity adjustment actuator 116. Actuations of the toggle actuator 114 toggle, i.e., alternately turn off and on, the lighting load 104. Preferably, the dimmer switch 110 may be programmed with a lighting preset intensity (i.e., a "favorite" intensity level), such that the dimmer switch is operable to control the intensity of the lighting load 104 to the preset intensity when the lighting load is turned on by an actuation of the toggle actuator 114. Actuations of an upper portion 116A or a lower portion 116B of the intensity adjustment actuator 116 respectively increase or decrease the amount of power delivered to the lighting load 104 and thus increase or decrease the intensity of the lighting load 104.

A plurality of visual indicators 118, e.g., light-emitting diodes (LEDs), are arranged in a linear array on the left side of the bezel 113. The visual indicators 118 are illuminated to provide feedback of the present intensity of the lighting load 104. Preferably, one of the plurality of visual indicators 118 that is representative of the present light intensity of the lighting load 104 is illuminated constantly. An example of a dimmer switch having a toggle actuator 114 and an intensity adjustment actuator 116 is described in greater detail in U.S. Pat. No. 5,248,919, issued Sep. 29, 1993, entitled LIGHTING CONTROL DEVICE, the entire disclosure of which is hereby incorporated by reference.

The remote control 120 comprises a plurality of actuators: an on button 122, a preset button 124, and an off button 126. The remote control 120 may also include raise and lower buttons (not shown), which operate to respectively raise and lower the intensity of the lighting load 104. The remote control 120 transmits packets (i.e., messages) via RF signals 106 (i.e., wireless transmissions) to the dimmer switch 110 in response to actuations of the on button 122, the preset button 124, and the off button 126. Preferably, a packet transmitted by the remote control 120 includes a preamble, a serial number associated with the remote control, and a command (e.g., on, off, or preset), and comprises 72 bits. If the RF signals are transmitted at 390 MHz, a packet is approximately 23 msec in length. In order to meet the standards set by the FCC, packets are transmitted such that there is not less than a predetermined time period $T_{MIN}$ (e.g., 100 msec) between two consecutive packets.

During a setup procedure of the RF lighting control system 100, the dimmer switch 110 is associated with one or more remote controls 120. The dimmer switch 110 is then responsive to packets containing the serial number of the remote control 120 to which the dimmer switch is associated. The dimmer switch 110 is operable to turn on and to turn off the lighting load 104 in response to an actuation of the on button 122 and the off button 126, respectively. The dimmer switch 110 is operable to control the lighting load 104 to the preset intensity in response to an actuation of the preset button 124.

Figure 2A:
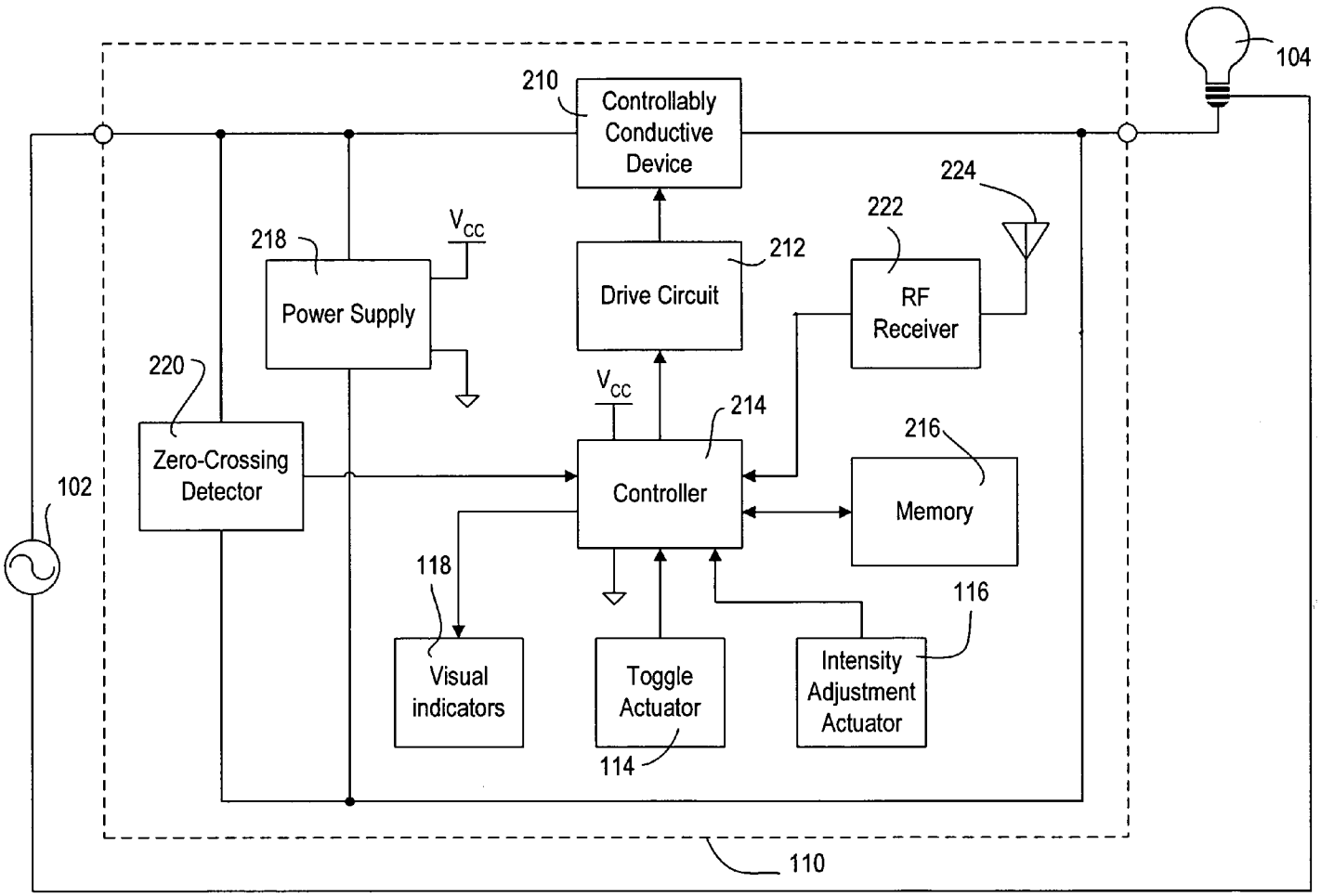
FIG. 2A is a simplified block diagram of the dimmer switch of the RF lighting control system of FIG. 1.

FIG. 2A is a simplified block diagram of the dimmer switch 110. The dimmer switch 110 comprises a controllably conductive device 210 coupled in series electrical connection between the AC power source 102 and the lighting load 104 for control of the power delivered to the lighting load. The controllably conductive device 210 may comprise any suitable type of bidirectional switch, such as, for example, a triac, a field-effect transistor (FET) in a rectifier bridge, or two FETs in anti-series connection. The controllably conductive device 210 includes a control input coupled to a drive circuit 212. The input to the control input will render the controllably conductive device 210 conductive or non-conductive, which in turn controls the power supplied to the lighting load 204.

The drive circuit 212 provides control inputs to the controllably conductive device 210 in response to command signals from a controller 214. The controller 214 is preferably implemented as a microcontroller, but may be any suitable processing device, such as a programmable logic device (PLD), a microprocessor, or an application specific integrated circuit (ASIC). The controller 214 receives inputs from the toggle actuator 114 and the intensity adjustment actuator 116 and controls the visual indicators 118. The controller 214 is also coupled to a memory 216 for storage of the preset intensity of lighting load 104 and the serial number of the remote control 120 to which the dimmer switch 110 is associated. A power supply 218 generates a direct-current (DC) voltage $V_{CC}$ for powering the controller 214, the memory 216, and other low-voltage circuitry of the dimmer switch 110.

A zero-crossing detector 220 determines the zero-crossings of the input AC waveform from the AC power supply 102. A zero-crossing is defined as the time at which the AC supply voltage transitions from positive to negative polarity, or from negative to positive polarity, at the beginning of each half-cycle. The zero-crossing information is provided as an input to controller 214 in the form of a pulse approximately every 8.3 msec (if the AC power source 102 is operating at 60 Hz). The controller 214 provides the control inputs to the drive circuit 212 to operate the controllably conductive device 210 (i.e., to provide voltage from the AC power supply 102 to the lighting load 104) at predetermined times relative to the zero-crossing points of the AC waveform.

The dimmer switch 110 further comprises an RF receiver 222 and an antenna 224 for receiving the RF signals 106 from the remote control 120. The controller 214 is operable to control the controllably conductive device 210 in response to the packets received via the RF signals 106. Examples of the antenna 224 for wall-mounted dimmer switches, such as the dimmer switch 110, are described in greater detail in U.S. Pat. No. 5,982,103, issued Nov. 9, 1999, and U.S. patent application Ser. No. 10/873,033, filed Jun. 21, 2006, both entitled COMPACT RADIO FREQUENCY TRANSMITTING AND RECEIVING ANTENNA AND CONTROL DEVICE EMPLOYING SAME. The entire disclosures of both are hereby incorporated by reference.

Figure 2B:
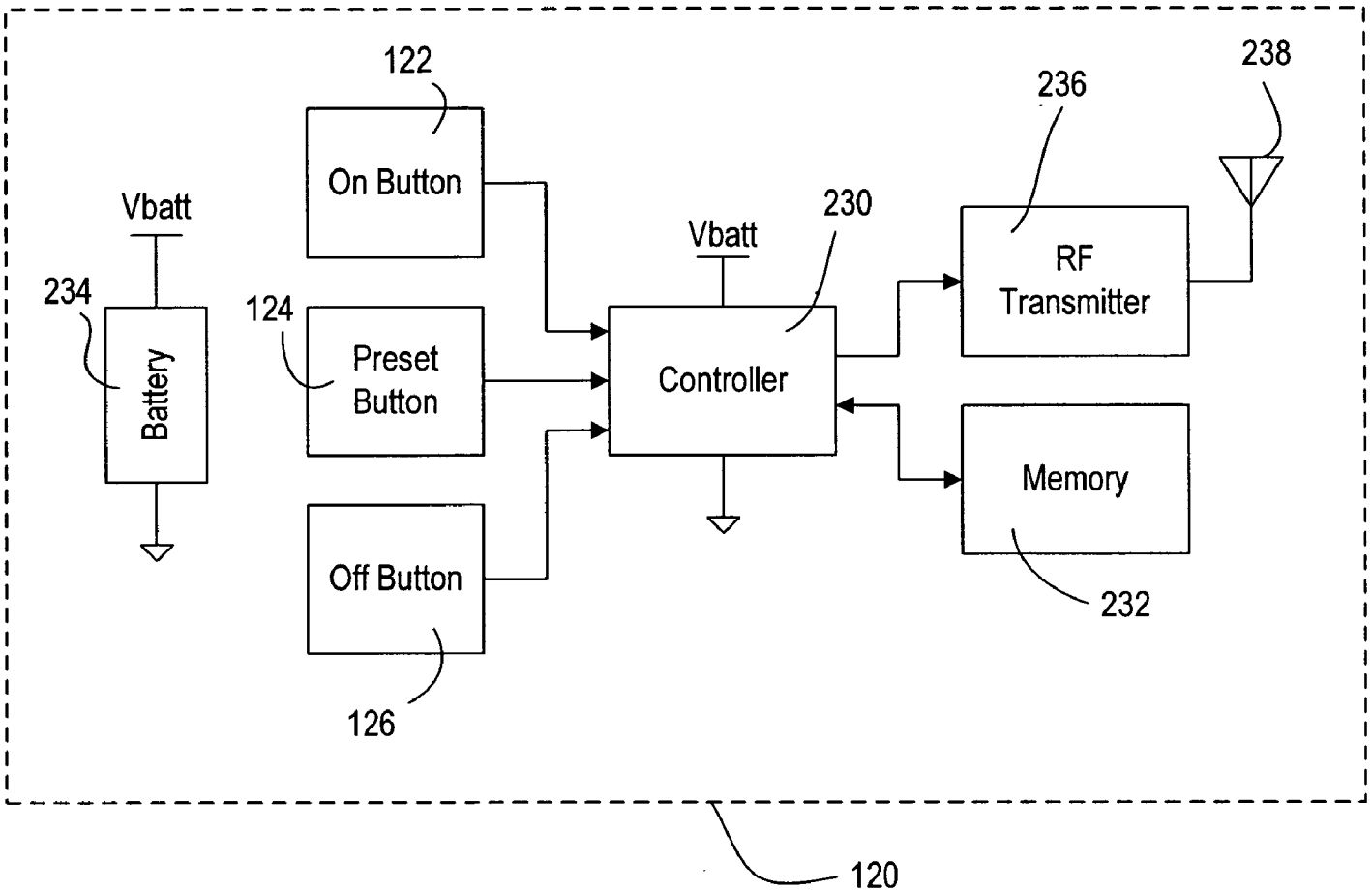
FIG. 2B is a simplified block diagram of the remote control of the RF lighting control system of FIG. 1.

FIG. 2B is a simplified block diagram of the remote control 120. The remote control 120 comprises a controller 230, which is operable to receive inputs from the on button 122, the preset button 124, and the off button 126. The remote control 120 further comprises a memory 232 for storage of the serial number, i.e., a unique identifier, of the remote control. Preferably, the serial number comprises a seven-byte number that is programmed into the memory 232 during manufacture of the remote control 120. A battery 234 provides a DC voltage $V_{BATT}$ for powering the controller 230, the memory 232, and other low-voltage circuitry of the remote control 120.

The remote control 120 further includes an RF transmitter 236 coupled to the controller 230 and an antenna 238, which may comprise, for example, a loop antenna. In response to an actuation of one of the on button 122, the preset button 124, and the off button 126, the controller 230 causes the RF transmitter 236 to transmit a packet to the dimmer switch 110 via the RF signals 106. As previously mentioned, each transmitted packet comprises a preamble, the serial number of the remote control 120, which is stored in the memory 232, and a command indicative as to which of the three buttons was pressed (i.e., on, off, or preset). Accordingly, a packet containing a preset command is referred to as a "preset packet". The remote control 120 ensures that there are 100 msec between each transmitted packet in order to meet the FCC standards.

The lighting control system 100 provides a simple one-step configuration procedure for associating the remote control 120 with the dimmer switch 110. A user simultaneously presses and holds the on button 122 on the remote control 120 and the toggle button 114 on the dimmer switch 110 to link the remote control 120 and the dimmer switch 110. The user may simultaneously press and hold the off button 126 on the remote control 120 and the toggle button 114 on the dimmer switch 110 to unassociate the remote control 120 with the dimmer switch 110. The configuration procedure for associating the remote control 120 with the dimmer switch 110 is described in greater detail in co-pending commonly-assigned U.S. patent Ser. No. 11/559,166, filed Nov. 13, 2006, entitled RADIO-FREQUENCY LIGHTING CONTROL SYSTEM, the entire disclosure of which is hereby incorporated by reference.

The lighting control system may comprise a plurality of remote controls 120 that can all be associated with one dimmer switch 110, such that the dimmer switch is responsive to presses of the buttons 122, 124, 126 of any of the plurality of remote controls. The user simply needs to repeat the association procedure of the present invention for each of the plurality of remote controls 120. Preferably, up to eight remote controls 120 may be associated with one dimmer switch 110.

Figure 2C:
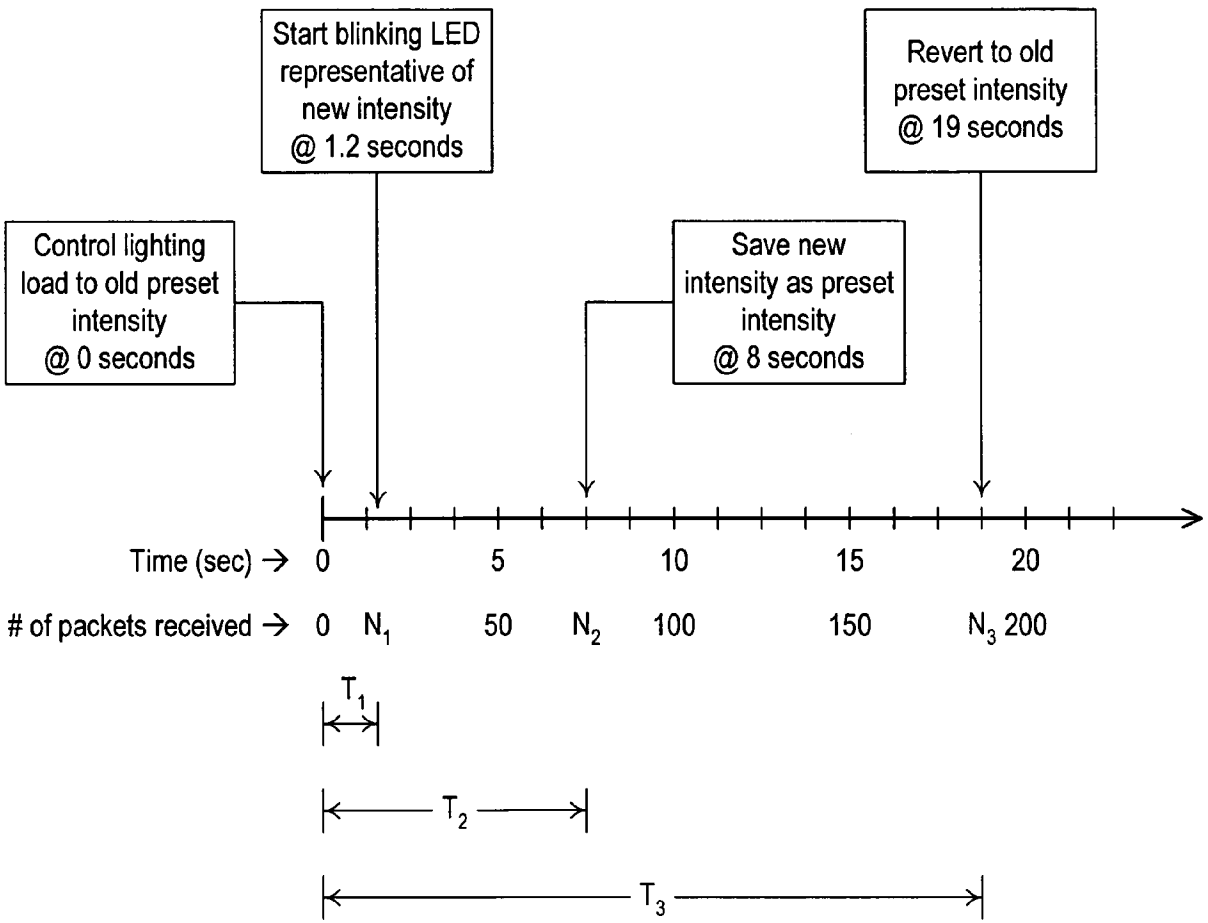
FIG. 2C is an example timeline showing the key events of the method of the present invention.

According to the present invention, the preset intensity of the dimmer switch 110 may be programmed from the remote control 120. To program a new preset intensity of the dimmer switch 110, a user first adjusts the intensity of the lighting load 104 to a new (i.e., desired) intensity. The user then presses and holds the preset button 124 of the remote control 120 to cause the dimmer switch to reassign the lighting preset to the new intensity. FIG. 2C is an example timeline showing the key events of the method of the present invention (if there is only 100 msec between each packet received by the dimmer switch 110). After the user first presses the preset button 124 of the remote control 120, the dimmer switch 100 must respond immediately in order to provide an acceptable response time (since the remote control only transmits packets every 100 msec). Accordingly, the dimmer switch 124 controls the intensity of the lighting load to the old preset intensity (i.e., the initial preset intensity) and constantly illuminates the corresponding visual indicator 118 after receiving a minimal number of packets, which preferably comprises three packets, but may be as few as one packet.

The dimmer switch 110 then determines if the preset button 124 of the remote control 120 is being held by counting the number of preset packets that are being received. After receiving a first predetermined number $N_1$ of packets (e.g., 12 packets) with no more than a first predetermined time period (e.g., 415 msec) between two consecutive packets, the dimmer switch 110 starts to blink the visual indicator 118 representative of the new intensity. After receiving a second predetermined number $N_2$ of packets (e.g., 80 packets) with no more than a second predetermined time period (e.g., 415 msec) between two consecutive packets, the dimmer switch 110 constantly illuminates the visual indicator 118 representative of the new intensity (rather than blinking the visual indicator), controls the lighting load 104 to the new intensity, and stores the new intensity as the preset intensity. Accordingly, the dimmer switch 110 begins the blink the visual indicator 118 representative of the new intensity after a first amount of time $T_1$ (e.g., approximately 1.2 seconds) while the preset button 124 is still being held, and then stores the new intensity as the preset intensity after a second amount of time $T_2$ (e.g., approximately 8 seconds).

The dimmer switch 110 is operable to revert to the old preset intensity if the dimmer switch 110 determines that the preset button 124 is "stuck", i.e., has been held down for a third amount of time $T_3$ (e.g., approximately 19 seconds). For example, an object may have fallen on the remote control 120 and is constantly actuating the preset button 124. Specifically, if the dimmer switch 110 receives a third predetermined number $N_3$ of packets (e.g., 190 packets) with no more than a third predetermined time period (e.g., 415 msec) between two consecutive packets, the dimmer switch once again stores the old preset intensity as the preset intensity.

Figure 3:
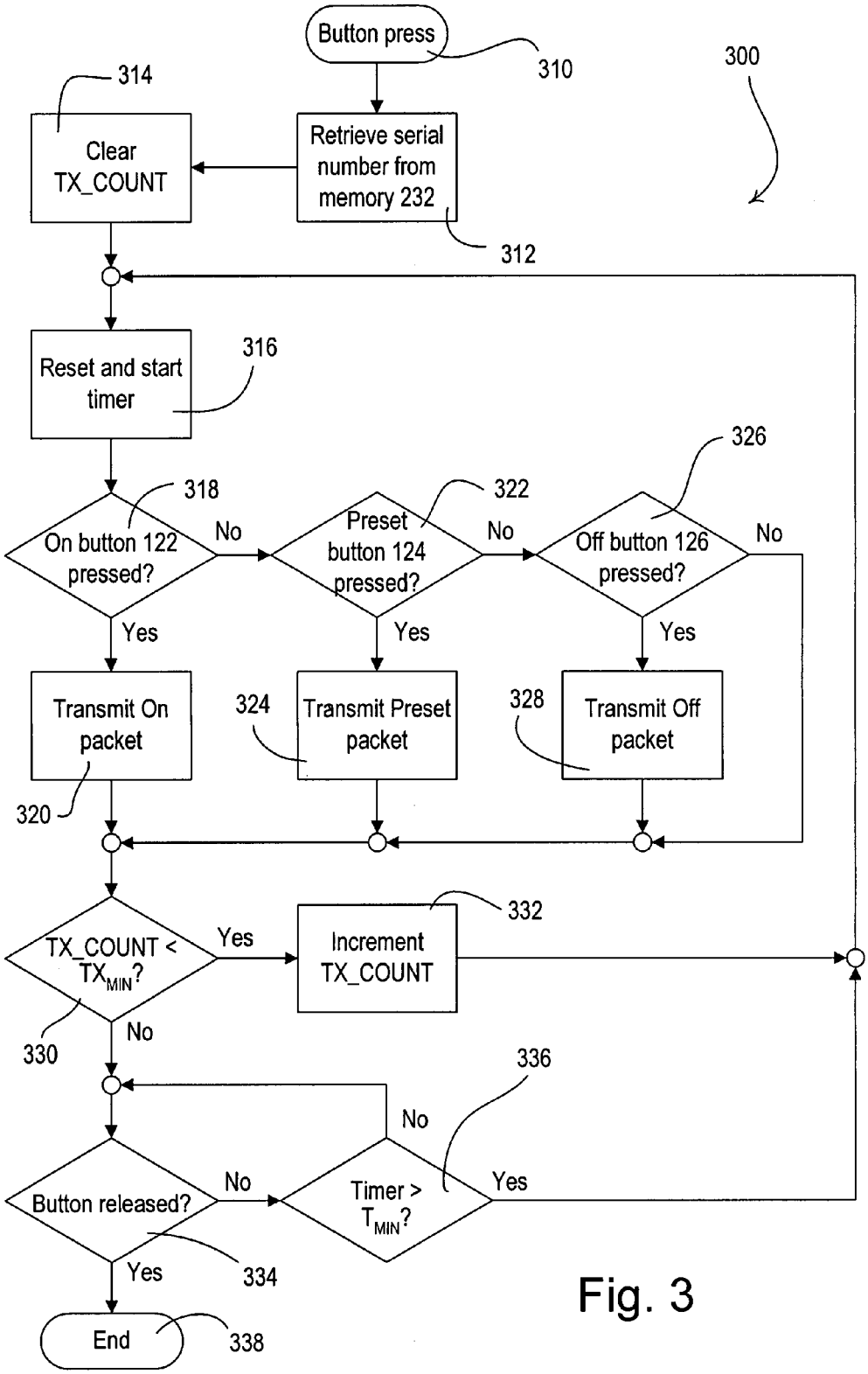
FIG. 3 is a flowchart of a button procedure executed by the controller of the remote control of FIG. 2B.

FIG. 3 is a flowchart of a button procedure 300 executed by the controller 230 of the remote control 120. The button procedure 300 is preferably executed when one of the buttons 122, 124, 126 is pressed (i.e., first depressed) at step 310. At step 312, the serial number of the remote control 120 is retrieved from the memory 232, such that the serial number can be transmitted in the packet to the dimmer switch 110. Next, a counter TX_COUNT is cleared at step 314. The counter TX_COUNT is used by the controller 230 in order to make sure that at least a predetermined number $TX_{MIN}$ of packets (e.g., four packets) are transmitted each time one of the buttoner 122, 124, 126 is pressed and released.

At step 316, a timer is reset and starts increasing with respect to time. The controller 230 uses the timer to ensure that there is not less than the predetermined time period $T_{MIN}$ (i.e., 100 msec) between two consecutive packets. If the on button 122 is pressed at step 318, an on packet is transmitted, i.e., the packet is transmitted with an on command, at step 320. Similarly, if the preset button is pressed at step 322 or the off button is pressed at step 326, a preset packet is transmitted at step 324 or an off packet is transmitted at step 328, respectively.

If the counter TX_COUNT is less than the predetermined number $TX_{MIN}$ of packets at step 330, the counter 230 increments the counter TX_COUNT and retransmits the packet at step 316, 320, or 324. When the counter TX_COUNT exceeds the predetermined number $TX_{MIN}$ Of packets at step 330, the button procedure 300 then loops until the button is released at step 334 or the timer has exceeded the predetermined time period $T_{MIN}$ at step 336. When the timer exceeds the predetermined time period $T_{MIN}$ at step 336 while the button is still held, the button procedure 300 loops to retransmit the packet once again at step 316, 320, or 324. If the button has been released at step 334, the button procedure 300 exits at step 338.

Figure 4:
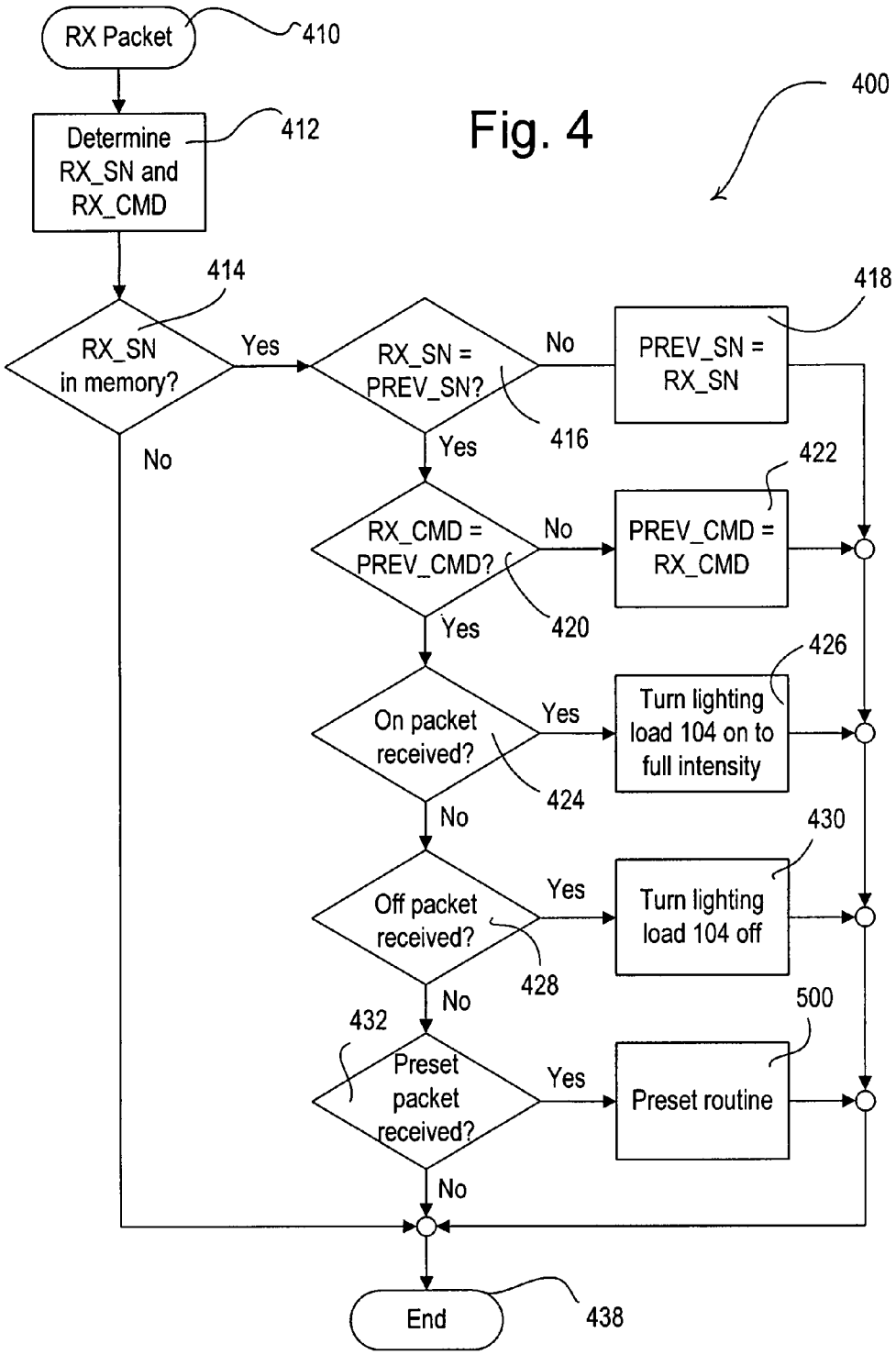
FIG. 4 is a flowchart of a packet receiving procedure executed by the controller of the dimmer switch of FIG. 2A.

FIG. 4 is a flowchart of a packet receiving procedure 400, which is also executed by the controller 214 of the dimmer switch 110. The packet receiving procedure 400 is interrupt-driven, i.e., the procedure 400 is executed when a packet is received at step 410. At step 412, the controller 214 determines the serial number and command of the received packet and stores these values in respective buffers RX_SN and RX_CMD. If the serial number RX_SN contained in the received packet is not stored in the memory 232 at step 414, the procedure 400 simply exits at step 438.

In order to prevent conflict between two remote controls 120 transmitting packets to the dimmer switch 110 at the same time, the controller 214 compares the serial number of the received packet (stored in the buffer RX_SN) with the serial number of the previous received packet, which is stored in a buffer PREV_SN. If the serial number RX_SN of the received packet is stored in the memory 232 at step 414, but the serial number RX_SN of the received packet is not equal to the serial number PREV_SN from the previous received packet at step 416, the serial number RX_SN of the received packet is stored in the buffer PREV_SN at step 418. Therefore, if the next packet received by the dimmer switch 100 includes the same serial number, the procedure 400 will continue on to step 420.

If the serial number RX_SN of the received packet is equal to the serial number PREV_SN from the previous received packet at step 416, a determination is made at step 420 as to whether the command RX_CMD of the received packet is equal to the command PREV_CMD form the previous received packet. If not, the command RX_CMD of the received packet is stored in the buffer PREV_CMD at step 422.

If the serial number RX_SN of the received packet is stored in the memory 232 at step 416, the serial number RX_SN of the received packet is equal to the serial number PREV_SN of the previous received packet at step 416, and the command RX_CMD of the received packet is equal to the command PREV_CMD of the previous received packet at step 420, a determination is made at steps 424, 428, and 432 as to what type of command has been received. Therefore, the controller 214 only operates on a packet (i.e., controls the lighting load 104 in response to a received packet) after receiving the same packet three times. In summary, the controller 214 stores the serial number RX_SN of the first received packet in the buffer PREV_SN at step 418, stores the command RX_CMD of the second received packet in the buffer PREV_CMD at step 422, and determines what the command RX_CMD of the third received packet is at steps 418, 422, 426.

If an on packet is received at step 424, the controller 214 turns the lighting load 104 on to full intensity at step 426 and the procedure 400 exits at step 438. If an off packet is received at step 428, the controller 214 turns off the lighting load 104 at step 430 and the procedure 400 exits at step 438. If a preset packet is received at step 432, the controller 214 executes a preset routine 500 before the packet receiving procedure 400 exits at step 438.

Figure 5:
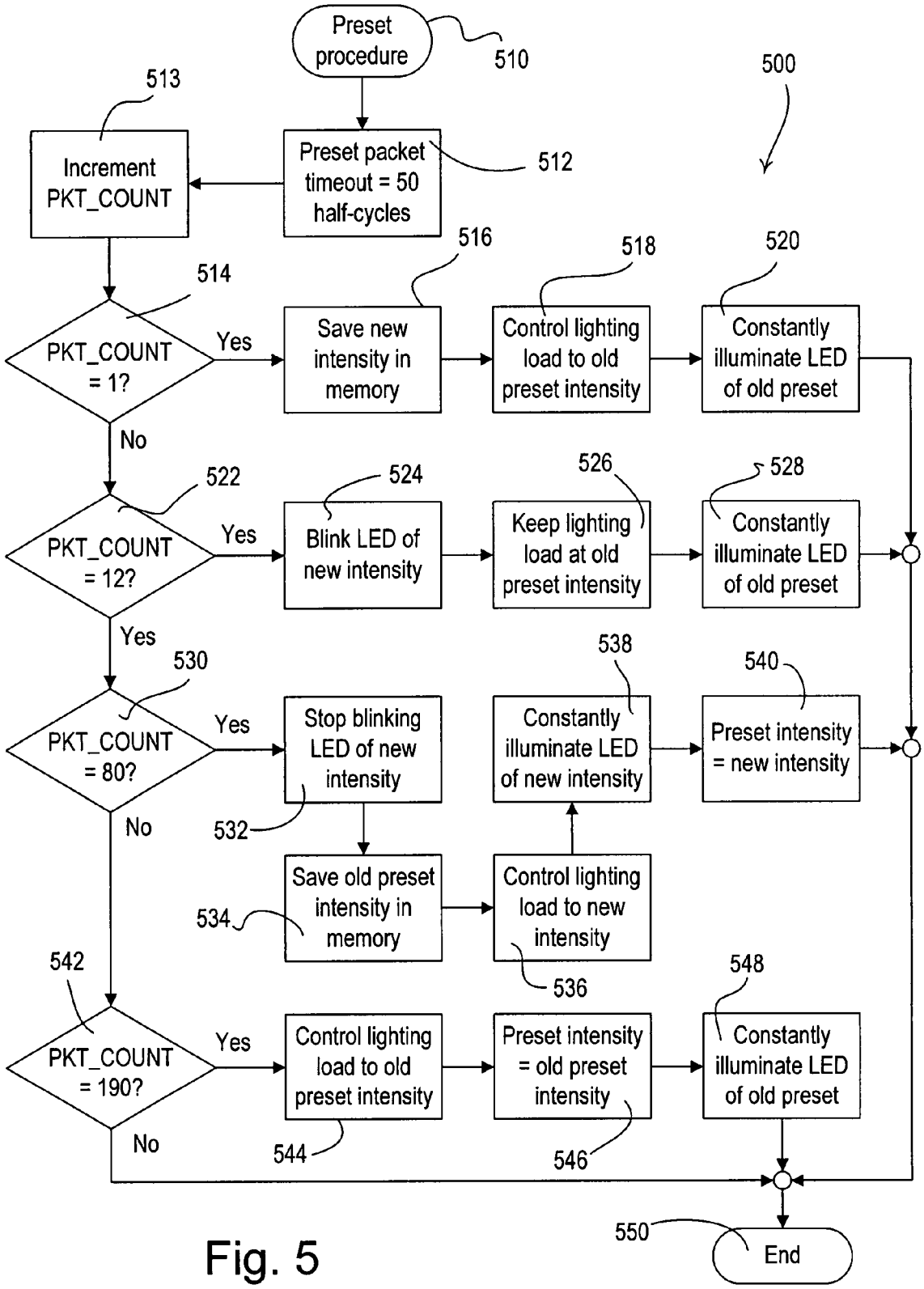
FIG. 5 is a flowchart of a preset routine of the packet receiving procedure of FIG. 4.

FIG. 5 is a flowchart of the preset routine 500, which is called from the packet receiving procedure 400 and starts at step 510. The controller 214 uses a preset packet timeout to ensure that the dimmer switch 110 does not respond to packets that are more than a maximum preset packet timeout period $T_{TIMEOUT}$ (i.e., approximately 415 msec) apart. The preset packet timeout is decremented by one during a preset packet timeout procedure 600, which is executed each half-cycle of the AC power source 102, i.e., in response to each zero-crossing of the AC power source. The preset packet timeout procedure 600 will be described in greater detail below with reference to FIG. 6. Since the zero-crossings occur approximately each 8.33 msec, the preset packet timeout period is preferably reset to 50 half-cycles at step 510, i.e., 50*8.33 msec=415 msec.

In order to program a new preset intensity, the user first adjusts the intensity of the lighting load 104 controlled by the dimmer switch 110 to the new intensity (i.e., the desired intensity). The user may then press and hold the preset button 124 of the remote control 120 to cause the dimmer switch 110 to save the new intensity as the preset intensity. The controller 214 of the dimmer switch 110 uses a variable PKT_COUNT to keep track of how many packets have been received, and thus, how long the preset button 124 of the remote control 120 has been held. The variable PKT_COUNT is reset to zero by the preset packet timeout procedure 600 when the preset timeout period reaches zero, i.e., when there is more than approximately 415 msec between two consecutively received packets. The variable PKT_COUNT is incremented by one at step 513 each time a consecutive preset packet is received.

Before pressing and holding the preset button 124 of the remote control 120, the user adjusts the intensity of the lighting load 104 to the desired intensity. To provide an acceptable response time to an actuation of the preset button 124, the dimmer switch 110 must control the lighting load 104 immediately after receiving the third preset packet. Accordingly, the first time a preset packet is processed by the preset procedure 500, i.e., when the variable PKT_COUNT is equal to one at step 514, the controller 214 saves the new intensity in the memory 232 at step 516, controls the lighting load 104 to the old preset intensity at step 518, and constantly illuminates the visual indicator 118 (i.e., LED) representative of the old preset intensity at step 520, before the procedure 500 exits at step 550.

If the preset button 124 of the remote control 120 is held for approximately the first amount of time $T_1$ (i.e., approximately 1.2 seconds), the dimmer switch 100 blinks the visual indicator 118 representative of the new intensity to signal that the dimmer switch is in the process of programming a new preset intensity. Specifically, after receiving the first predetermined number $N_1$ of packets (i.e., 12 packets) with no more than the first predetermined time period (i.e., 415 msec) between two consecutive packets (i.e., when the variable PKT_COUNT is equal to 12 at step 522), the controller 214 begins to blink the appropriate visual indicator 118 (i.e., LED) at step 524. Then, the controller 214 maintains the lighting load 104 at the old preset intensity at step 526, continues to constantly illuminate the visual indicator 118 representative of the old preset intensity at step 528, and exits the procedure 500 at step 550.

After the preset button 124 of the remote control 120 is held for approximately the second amount of time $T_2$ (i.e., approximately 8 seconds), the dimmer switch 110 saves the new intensity as the preset intensity. If the variable PKT_COUNT is equal to 80 at step 530, i.e., the controller 214 has received the second predetermined number $N_2$ of packets (i.e., 80 packets) with no more than the second predetermined time period (i.e., 415 msec) between two consecutive packets, the controller 214 stops blinking the visual indicator 118 representative of the new preset intensity at step 532. At step 534, the controller 214 saves the old preset intensity in memory 232. Accordingly, the controller 214 can recall the old preset intensity if the controller 214 determines that the preset button 124 has been held for too long (i.e., is "stuck") as will be described below. Next, the controller 214 controls the lighting load 104 to the new intensity at step 536 and constantly illuminates the visual indicator 118 representative of the new intensity at step 538. Then, the new intensity is stored as the preset intensity at step 540 and the procedure 500 exits at step 550.

If the preset button 124 is held for more than the third amount of time $T_3$ (i.e., approximately 19 seconds), the controller 214 assumes that the preset button is "stuck". If the variable PKT_COUNT is equal to 190 at step 542, i.e., the controller 214 has received the third predetermined number $N_3$ of packets (i.e., 190 packets) with no more than the third predetermined time period (i.e., 415 msec) between two consecutive packets, the controller 214 controls the lighting load 104 at step 544 to the old preset intensity, which is stored in the memory 232. The controller 214 then stores the old preset intensity as the preset intensity at step 546, constantly illuminates the visual indicator 118 representative of the old preset intensity at step 548, and exits the procedure 500 at step 550.

Figure 6:
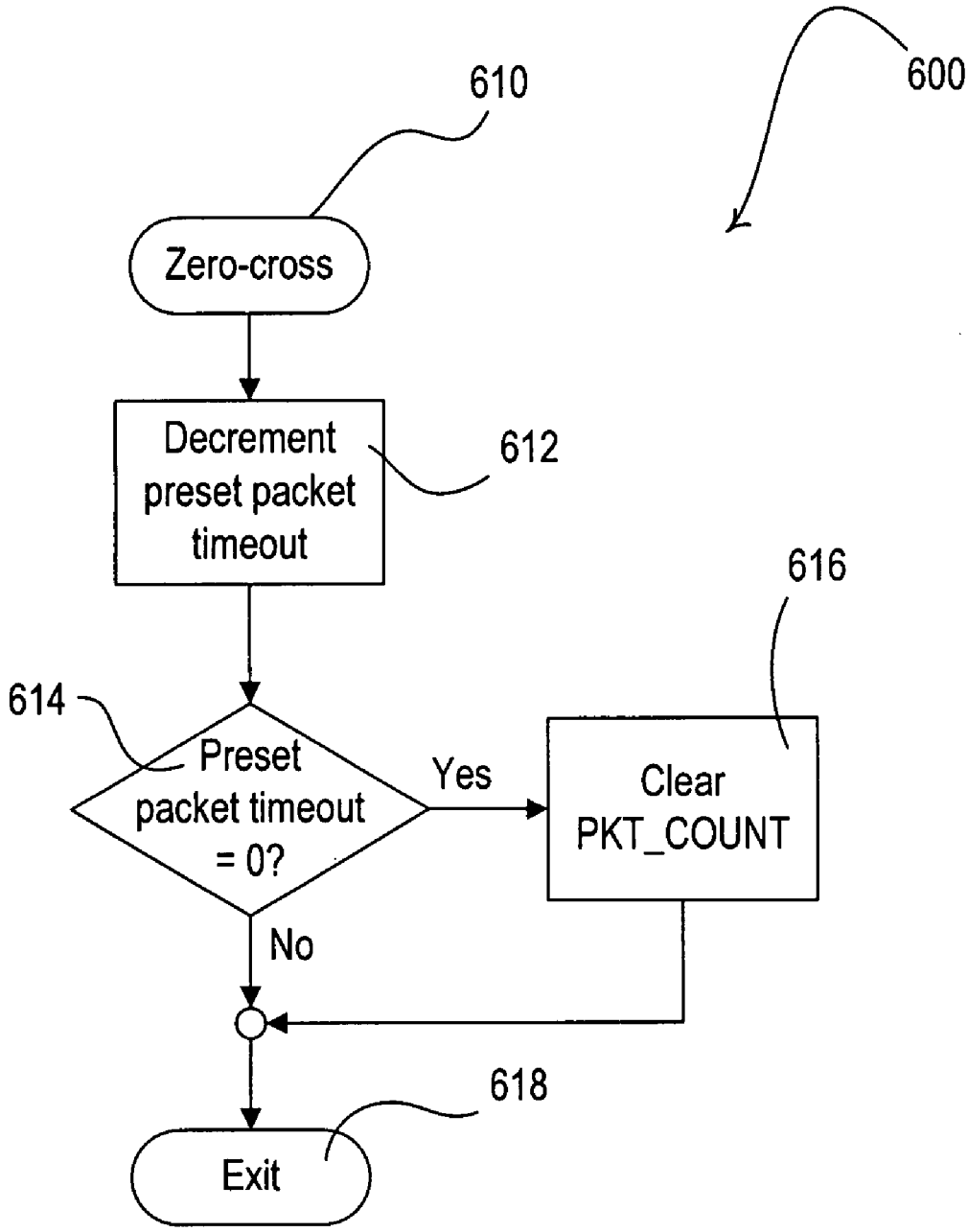
FIG. 6 is flowchart of a preset packet timeout procedure executed by the controller of the dimmer switch of FIG. 2A.

FIG. 6 is flowchart of the preset packet timeout procedure 600 executed by the controller 214 of the dimmer switch 110 at step 610 at each zero-crossing of the AC power source 102, i.e., in response to the zero-crossing information provided by the zero-crossing detector 220. The preset packet timeout is decremented by one at step 612 each half-cycle of the AC power source 102. If the preset packet timeout not equal to zero at step 614, the procedure 400 simply exits at step 618. However, if the preset packet timeout has reached zero at step 614, i.e., if more than 415 msec has passed since the last preset packet was received, the controller 124 clears the variable PKT_COUNT at step 616.

Since remote control 120 transmits the preset packets approximately every 100 msec and the dimmer switch 100 does not respond to packets that are more than the maximum preset packet period $T_{TIMEOUT}$ (i.e., approximately 415 msec) apart, the dimmer switch is operable to miss three consecutive preset packets without clearing the variable PKT_COUNT. However, if the dimmer switch 110 does not receive four consecutive packets (i.e., there is more than 415 msec between two consecutive packets), the variable PKT_COUNT is reset and the user must re-press the preset button 124 in order to begin the preset programming process again.

Since the worst case time between two consecutive packets without the variable PKT_COUNT being reset to zero is approximately 400 msec, the maximum values of the first, second, and third amounts of time $T_1$, $T_2$, $T_3$ are 4.8 seconds, 32 seconds, and 76 seconds.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The numbers of packets, the amounts of time, and the other numerical values are provided as examples in regards to the preferred embodiment of the present invention and should not be construed to limit the scope of the present invention. For example, it would be well within the capabilities of one having ordinary skill in the art to modify the number of packets to be received for the dimmer switch to respond as described herein and still obtain the method of the present invention.

What is claimed is:

1. A method of programming a preset intensity of a load control device, the load control device operable to control the amount of power delivered to a lighting load from an AC power source such that the lighting load is illuminated to the preset intensity, the method comprising the steps of:

controlling the intensity of the lighting load to an old preset intensity in response to receiving a wireless transmission;

providing a visual indication representative of a new intensity in response to receiving a first predetermined number of the wireless transmissions with no more than a first predetermined time period between two consecutive wireless transmissions; and storing the new intensity as the preset intensity in response to receiving a second predetermined number of the wireless transmissions with no more than a second predetermined time period between two consecutive wireless transmissions.

2. The method of claim 1, further comprising the steps of:

controlling the intensity of the lighting load to the new intensity in response to receiving the second predetermined number of the wireless transmissions with no more than the second predetermined time period between two consecutive wireless transmissions; and ceasing to provide the visual indication in response to receiving the second predetermined number of the wireless transmissions with no more than the second predetermined time period between two consecutive wireless transmissions.

3. The method of claim 2, further comprising the steps of:

storing the old preset intensity as the preset intensity in response to receiving a third predetermined number of the wireless transmissions with no more than a third predetermined time period between two consecutive wireless transmissions; and controlling the intensity of the lighting load to the old preset intensity in response to receiving the third predetermined number of the wireless transmissions with no more than the third predetermined time period between two consecutive wireless transmissions.

4. The method of claim 3, wherein the first, second, and third predetermined time periods are each approximately 415 msec.

5. The method of claim 3, wherein the first predetermined number of packets is approximately twelve, the second predetermined number of packets is approximately 80, and the third predetermined number of packets is approximately 190.

6. The method of claim 1, further comprising the step of:

controlling the intensity of the lighting load to the new intensity prior to the step of controlling the intensity of the lighting load to an old preset intensity in response to receiving a wireless transmission.

7. The method of claim 6, further comprising the step of:

constantly illuminating a first visual indicator of the load control device in response to the step of controlling the intensity of the lighting load to an old preset intensity in response to receiving a wireless transmission;

wherein the step of providing a visual indication further comprises blinking a second visual indicator of the load control device in response to receiving a first predetermined number of the wireless transmissions with no more than a first predetermined time period between two consecutive wireless transmissions, the second visual indicator representative of the new intensity.

8. The method of claim 7, further comprising the steps of:

controlling the intensity of the lighting load to the new intensity in response to receiving the second predetermined number of the wireless transmissions with no more than the second predetermined time period between two consecutive wireless transmissions; and constantly illuminating the second visual indicator of the load control device in response to receiving the second predetermined number of the wireless transmissions with no more than the second predetermined time period between two consecutive wireless transmissions.

9. The method of claim 1, wherein the step of providing a visual indication further comprises blinking a visual indicator of the load control device, the visual indicator representative of the new intensity.

10. The method of claim 1, wherein each wireless transmission comprises a packet.

11. The method of claim 1, wherein the wireless transmissions comprise a serial number of the load control device.

12. The method of claim 1, further comprising the steps of:

pressing and holding an actuator of a remote control; and the remote control repeatedly transmitting the wireless transmissions in response to the step of pressing and holding an actuator.

13. The method of claim 1, further comprising the step of:

storing a present intensity of the lighting load in a memory in response to receiving the wireless transmission prior to the step of controlling the intensity of the lighting load to an old preset intensity;

wherein the step of storing the new intensity as the preset intensity further comprises setting the preset intensity equal to the intensity that is stored in the memory.

14. A dimmer switch for controlling the amount of power delivered to a lighting load from an AC power source such that the lighting load is illuminated to a preset intensity, the dimmer switch comprising:

a controllably conductive device adapted to be coupled in series electrical connection between the AC power source and the lighting load, the controllably conductive device having a control input;

a controller operatively coupled to the control input of the controllably conductive device for controlling the intensity of the lighting load;

a wireless receiver operable to receive a wireless transmission and coupled to the controller such that the controller is responsive to the wireless transmission; and a plurality of visual indicators coupled to the controller and operable to provide a representation of the intensity of the lighting load;

wherein the controller is operable to control the intensity of the lighting load to a new intensity, to control the intensity of the lighting load to an old preset intensity in response to receiving the wireless transmission, to blink one of the plurality of visual indicators representative of the new intensity in response to receiving a first predetermined number of the wireless transmissions with no more than a first predetermined time period between two consecutive wireless transmissions, and to store the new intensity as the preset intensity in response to receiving a second predetermined number of the wireless transmissions with no more than a second predetermined time period between two consecutive wireless transmissions.

15. The dimmer switch of claim 14, wherein the controller is further operable to control the intensity of the lighting load to the new intensity and constantly illuminate the one of the visual indicators that is representative of the new intensity in response to receiving the second predetermined number of the wireless transmissions with no more than the second predetermined time period between two consecutive wireless transmissions.

16. The dimmer switch of claim 15, wherein the controller is further operable to store the old preset intensity as the preset intensity and control the intensity of the lighting load to the old preset intensity in response to receiving a third predetermined number of the wireless transmissions with no more than a third predetermined time period between two consecutive wireless transmissions.

17. The dimmer switch of claim 14, wherein the controller is further operable to constantly illuminate a second visual indicator that is representative of the old preset intensity in response to receiving the wireless transmission.

18. The dimmer switch of claim 14, further comprising:

a memory for storing a present intensity of the lighting load before the controller controls the intensity of the lighting load to the old preset intensity in response to receiving the wireless transmission;

wherein the controller stores the new intensity as the preset intensity by setting the preset intensity equal to the intensity that is stored in the memory.

19. A lighting control system for controlling the amount of power delivered to a lighting load from an AC power source such that the lighting load is illuminated to a preset intensity, the lighting control system comprising:

a remote control operable to transmit a wireless transmission in response to an actuation of a button; and a dimmer switch operable to control intensity of the lighting load to a new intensity, the dimmer switch further operable to control the lighting load to an old preset intensity in response to receiving the wireless transmission, to provide a visual indication representative of the new intensity in response to receiving a first predetermined number of the wireless transmissions with no more than a first predetermined time period between two consecutive wireless transmissions, and to store the new intensity as the preset intensity in response to receiving a second predetermined number of the wireless transmissions with no more than a second predetermined time period between two consecutive wireless transmissions.

* * * * *